US005156269A

United States Patent [19]

Bakx

[11] Patent Number: 5,156,269

[45] Date of Patent: Oct. 20, 1992

[54] WRAP-AROUND CARTON WITH END CLOSURE PANELS

[75] Inventor: Martinus C. M. Bakx, Roosendaal, Netherlands

[73] Assignee: The Mead Corporation, Dayton, Ohio

[21] Appl. No.: 835,178

[22] Filed: Feb. 13, 1992

[30] Foreign Application Priority Data

Feb. 14, 1991 [GB] United Kingdom ..... 9103135

[51] Int. Cl.[5] ..... B65D 65/12

[52] U.S. Cl. ..... 206/427; 229/40

[58] Field of Search ..... 206/427; 229/40

[56] References Cited

U.S. PATENT DOCUMENTS

| | | | |
|---|---|---|---|
| 3,270,914 | 9/1966 | Graser | 229/40 X |
| 3,294,280 | 12/1966 | Graser | 229/40 X |
| 3,688,972 | 9/1972 | Mahon | 229/40 |
| 4,597,523 | 7/1986 | Schuster | 229/40 |
| 4,901,849 | 2/1990 | Wilson | 229/40 X |
| 4,925,019 | 5/1990 | Ganz et al. | 206/145 |

FOREIGN PATENT DOCUMENTS

| | | |
|---|---|---|
| 1125626 | 8/1968 | United Kingdom . |
| 1501714 | 2/1978 | United Kingdom . |
| 2006708 | 5/1979 | United Kingdom . |

*Primary Examiner*—William I. Price
*Attorney, Agent, or Firm*—Erwin Doerr

[57] ABSTRACT

A carton of the wraparound type comprises top (18) and bottom panels (12, 24) connected together by spaced side wall panels (14,16:20,22) forming a tubular structure has a set of end panels at each end of the tubular structure to close the ends of the carton. Each set comprises a pair of end closure panels hinged to respective ones of the side wall panels and folded towards one another to close the end. Each of the end closure panels (38, 38':52, 52') are connected to upper parts (16, 20) of the adjacent side wall panels by an interconnecting panel (70, 70': 80, 80') which secures upper parts (**38*a*, 1538*a*': 52*a*, 52*a*'**) of the end closure panels in a closed position such that they extend inwardly and upwardly.

6 Claims, 3 Drawing Sheets

10
12
14
16
18
20
22
24
26
30
32
34
36
38
38a
38b
38'
38a'
38b'
40
40'
42
42'
44
44'
46
46'
48
48'
50
50'
52
52a
52b
52'
52a'
52b'
56
56'
58
60
60'
62
62'
64
64'
66
66'
68
68'
70
70'
72
72'
74
74'
76
76'
78
78'
80
80'
82
82'
84
84'
86
86'
88
88'
A
R
T

WRAP-AROUND CARTON WITH END CLOSURE PANELS

This invention relates to a carton for accommodating articles such as bottles, of the wraparound type which is provided with a set of end closure panels at each end of the carton which close the ends of the carton.

Each set of end closure panels comprise a pair of panels hinged to the side walls of the carton and which fold across an open end of the carton towards one another and a further panel hinged to a top wall of the carton which is folded 180 degrees inwardly into overlapping relationship with portions of the said top or bottom wall panels.

U.S. Pat. No. 3,688,972 discloses a carton for bottles having a single end closure panel door for closing each end of the carton. The upper portion of each door is inwardly and upwardly inclined or indented and is hinged to an adjacent side wall panel by a hinged intermediate gusset.

U.S. Pat. No. 4,597,523 also discloses a wraparound type carton for bottles in which an upper end closure panel is connected to a pair of end closure doors by a pair of hinged intermediate panels which themselves are inwardly sloped when the end door panels are closed.

U.S. Pat. No. 4,925,019 discloses a wraparound carton having end closure panels which includes a so-called gusset trap which comprises gusset panels with relief openings which when the end closure panels are closed the relief openings are able to clear the upper portion of an article e.g. the neck finish of a bottle and the gusset arrangement adhered to the underface of the top wall panel of the carton.

The invention provides a carton of the wraparound type for bottles which carton comprises top and bottom panels connected together by spaced side wall panels thereby forming a tubular structure and a set of end panels at each end of the tubular structure to close the ends of the carton, each said set comprising a pair of end closure panels hinged to respective ones of the side wall panels which are folded across that end of the tubular structure towards one another to close at least partially said end and an intermediate panel hinged to the top panel of the carton, each of said end closure panels being hinged to respective ones of the adjacent side wall panels at least in part by an interconnecting panel and to said intermediate panel by means of respective gusset panels said intermediate panel and the associated gusset panels being disposed in flat superposed relationship with respect to said top or said base panel when the end closure panels are closed.

According to a feature of the invention uppermost ends of each end panel may slope inwardly and upwardly.

According to another feature of the invention said intermediate panel and each of said end closure panels may be connected by hinged panels constituting said upper parts of said end closure panels.

According to yet another feature of the invention said interconnecting panels may be hinged to upper parts of the adjacent side wall panels, to upper parts of the adjacent end closure panels and to said intermediate panel.

According to a further feature of the invention said interconnecting panels may be disposed in overlapping relationship with upper parts of said side wall panels.

According to a still further feature of the invention said gusset panels may be connected to said intermediate panels and upper portions of said end closure panels.

According to a still further feature of the invention each of said end closure panels may be connected to a bottom panel by foldable gusset panels adaped to provide a two-ply element at each lower corner of said carton.

Another aspect of the invention provides a blank for forming a carton of the wraparound type which blank comprises a series of main panels hinged one to the next so as to be capable of forming a sleeve and end closure panels hinged along each of the opposite edges of the main panels so as to be capable of closing the ends of the sleeve and wherein said main panels include upper and lower side wall panels hinged to each side of a central main panel, each set of said end closure panels comprising lower end closure panels hinged to respective lower side wall panels and upper end closure panels hinged to interconnecting panels which themselves are hinged to respective upper side wall panels said upper end closure panels being hinged to a common intermediate panel by means of hinged gusset panel and said intermediate panel being hinged to said central main panel.

An embodiment of the invention will now be described, by way of example, with reference to the accompanying drawings in which.

Figure 1:
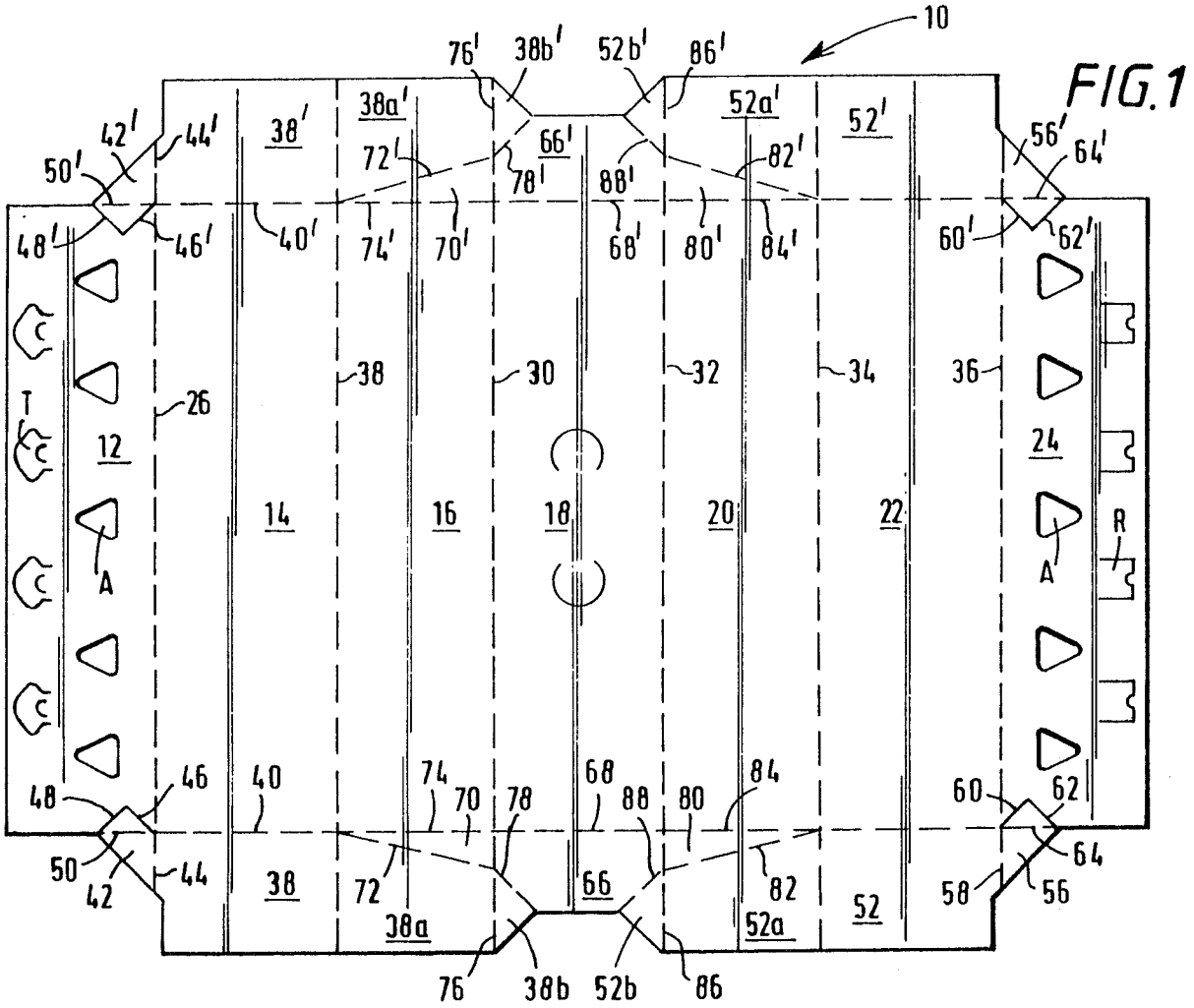
FIG. 1 is a plan view of a paperboard blank for forming a carton according to the invention.
Figure 2:
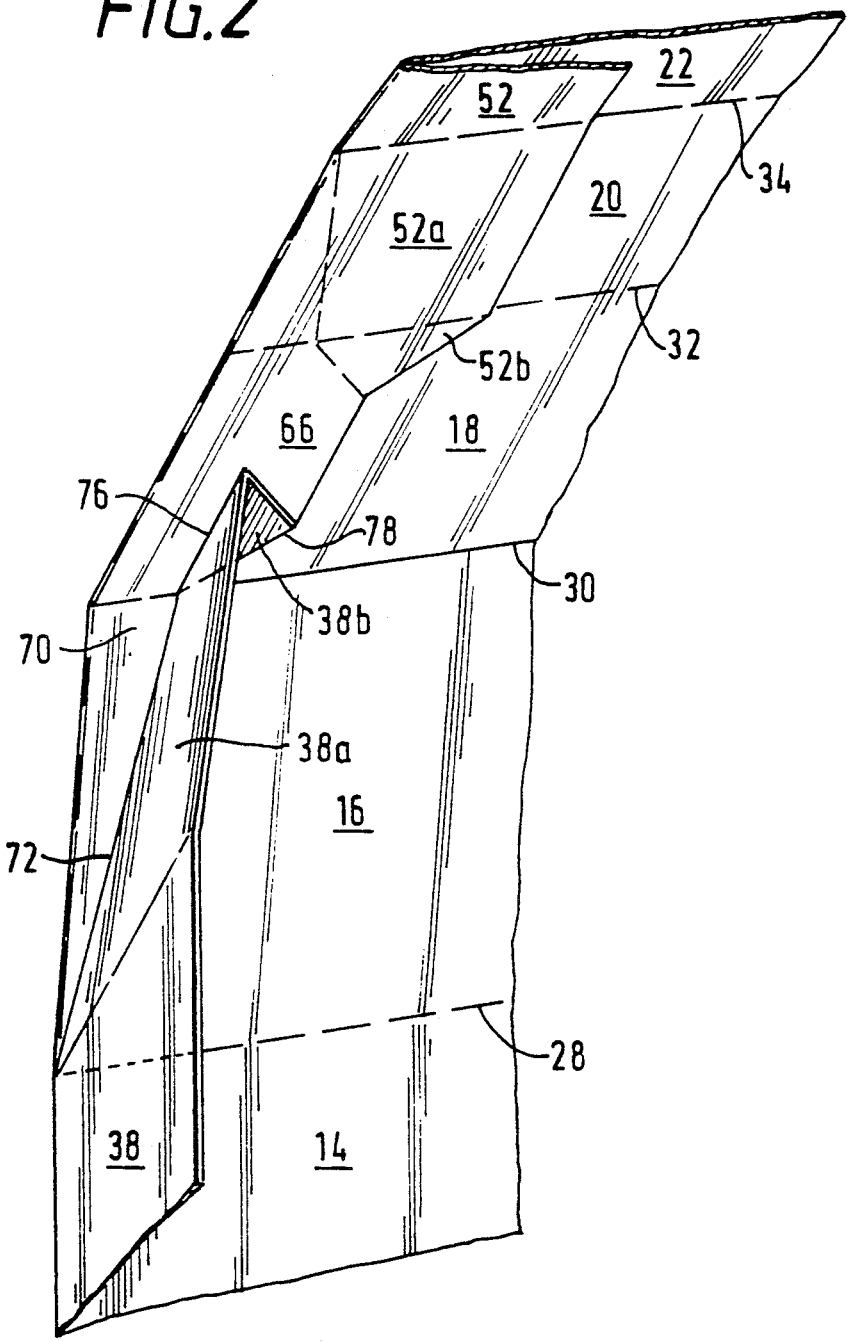
FIG. 2 is a perspective view showing in part one end of a partially formed carton utilizing the blank of FIG. 1 and in which certain panels are shown folded.
Figure 3:
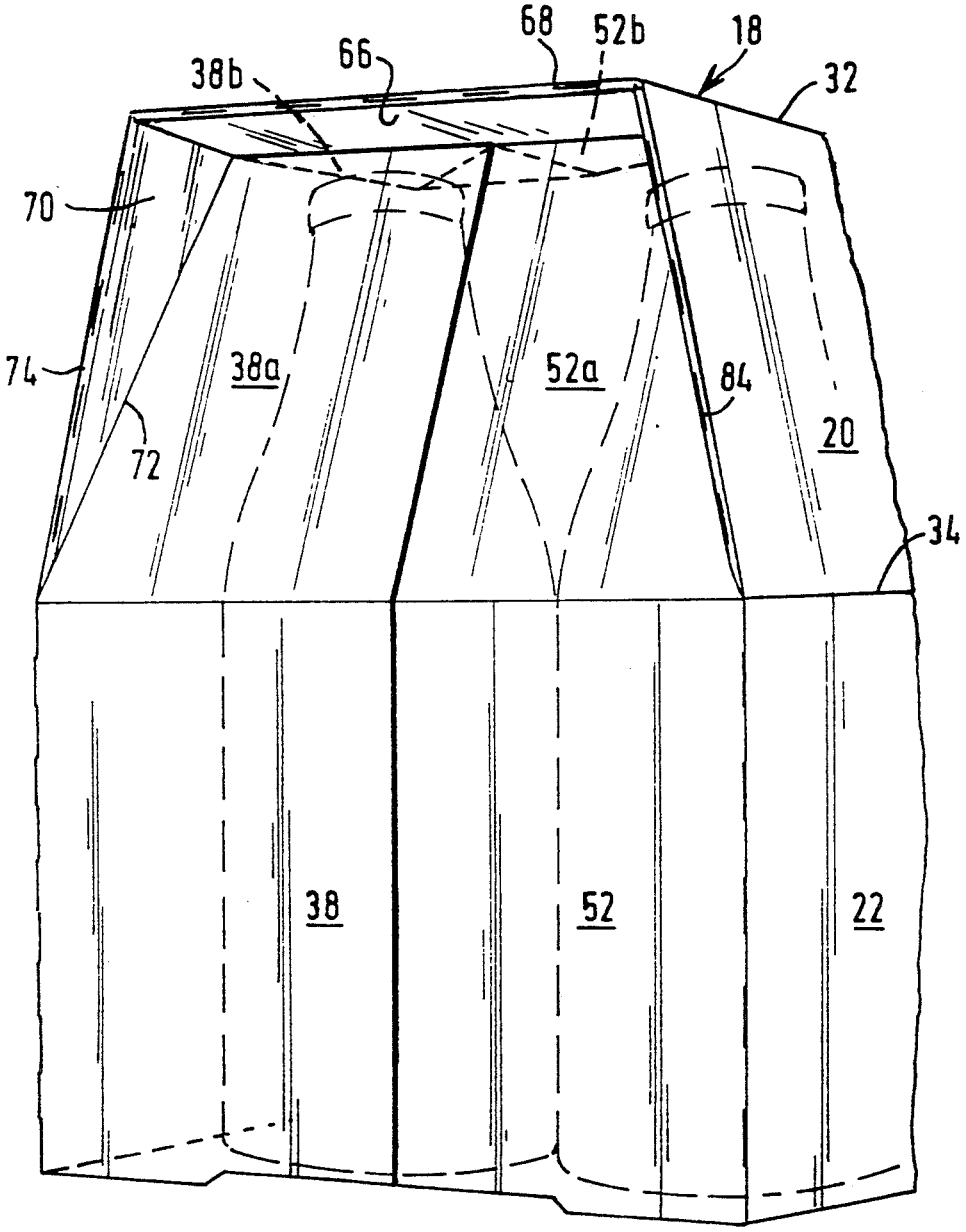
FIG. 3 is a perspective view of the upper end of a carton formed from the blank shown in FIG. 1.

Referring to the drawings, there is shown (in FIG. 1) an elongate blank 10 of paperboard or similar foldable sheet material. The blank comprises, in series a first base panel 12, a first lower side wall panel 14, a first upper side wall panel 16, a top panel 18, a second upper side wall panel 20, a second lower side wall panel 22 and a second base panel 24, hinged one to the next along transverse fold lines 26–30. Base panel 12 is formed with a plurality of locking tabs "T" which co-operate with locking apertures defined by retaining tabs "R" formed at spaced locations in base panel 24 in order to lock the base panels together in overlapping relationship and thereby hold the blank in a tubular form.

Apertures "A" of deltoid shape are formed in both base panels and are utilised to draw the base panels together into overlapping relationship as is well known in the art. In order to close the ends of the carton when it is in its "wrap-around" form a set of end closure panels is formed along each of the longitudinal edges of the blank.

In one set of end closure panels, an end closure panel 38 is hinged to first lower side wall panel 14 along a fold line 40 and includes a foldable gusset panel 42 which interconnects along fold lines 44 and 46, respectively, the lower end of the end closure panel 38 to the base panel 12. Gusset panel 42 is detached from the base panel 12 along cut line 48 and can fold inwardly by virtue of intermediate fold line 50 to adopt a flat form on top of the base panel 12 when the end closure panel 38 is closed.

A second end closure panel 52 is hinged to second lower side wall panel 22 along a fold line 54 and includes a foldable gusset panel 56 which interconnects along fold lines 58 and 60, respectively, the lower end of the end closure panel 52 to the base panel 24. Gusset panel 56 is detached from the base panel 24 along cut line 62 and can fold inwardly by virtue of intermediate fold line 64 to adopt a flat form on top of the base panel 24 when the end closure panel 52 is closed.

This end closure panel set also includes an intermediate panel 66 which is hinged to the top panel 18 along longitudinal fold line 68. End closure panel 38 includes an upper portion 38*a* which is hinged to an interconnecting panel 70 along fold line 72 and is hinged to upper side wall panel 16 along fold line 74. A triangular gusset panel part 38*b* is hinged to upper portion 38*a* along fold line 76 and to intermediate panel 66 along fold line 78.

End closure panel 52 also includes an upper portion 52*a* which is hinged to a connecting panel 80 along fold line 82 and also is hinged to upper side wall panel 20 along fold line 84. A triangular gusset panel part 52*b* of panel 52 is hinged to upper portion 52*a* along fold line 86 and to intermediate panel 66 along fold line 88.

The opposite set of end closure panels hinged along the opposite longitudinal edges of the main wall panels of the blank are identical to the set of end closure panels described above and accordingly like parts are designated like reference numerals with the addition of the suffix"'".

In order to form the completed carton, the blank is wrapped about a group of pre-arranged articles such as bottles and once the base panels 12 and 24 have been brought into overlapping alignment and locked together the ends of the carton are ready to be closed.

However, during the application process the intermediate panels 66, 66' are folded downwardly out of the plane of the blank about fold lines 68, 68' respectively. Thus, because of the foldable connections between all the panels in each of the end closure panels sets the end closure panels along each longitudinal edge of the blank fold together in like manner to that of intermediate panels 66 and 66'. Immediately thereafter the blank is folded along transverse fold line 30 and 32 to bring the side walls (and associated base panels) into a perpendicular position relative to the top wall panel 18. This folding process automatically causes the triangular top gusset panel parts 38*b*, 38*b'* and 52*b*, 52*b'* and the connecting panels 70, 70'; and 80, 80' to fold relative to the adjacent panels so that the upper portions 38*a*, 38*a'* and 52*a*, 52*a'* of the end closure panels slope upwardly and inwardly. Folding is completed when the intermediate panels 66 and 66' are in substantially flat overlapping relationship with the top panel 18 and in which the triangular gusset panel parts 38*b*, 38*b'* and 52*b*, 52*b'* are in substantially flat overlapping relationship with respective ones of the intermediate panels 66, 66'.

The interconnecting panels 70, 70' and 80, 80' are drawn against upper portions of the respective side walls by virtue of the interconnecting gusset panel parts 38*b*, 38*b'* and 52*b*, 52*b'*. The end closure panel pairs 38, 52 and 38', 52' of course then meet across the ends of the carton. Thus one end of the carton is closed by one set of end closure panels and the other end of the carton is closed by the opposed set of end closure panels.

The inward and upward sloping top parts 38*a*, 38*a'* and 52*a*, 52*a'* of the end closure panels are maintained in those attitudes by the triangular interconnecting panels 70, 70' and 80, 80' hinged thereto.

During the folding of the end closure panels the lower gusset panels 42 and 56 are tucked into the ends of the carton by folding about lines 44, 46, 50 and 58, 60, 64 respectively so that the lower gusset panels are placed into overlapping relationship with the base panels 12 and 24 respectively when the latter are folded inwardly. Likewise lower gusset panels 42' and 56' are tucked into the opposite ends of the carton.

The carton is completed by folding the base panels 12 and 24 relative to the side wall panels into overlapping relationship and then interengaging the locking tabs and locking apertures as is well known in the art.

I claim:

1. A carton of the wraparound type for bottles which carton comprises top and bottom panels connected together by spaced side wall panels thereby forming a tubular structure and a set of end panels at each end of the tubular structure to close the ends of the carton, each said set comprising a pair of end closure panels hinged to respective ones of the side wall panels and folded across that end of the tubular structure towards one another, and an intermediate panel hinged to the top panel of the carton, each of said end closure panels being hinged to respective ones of the adjacent side wall panels at least in part by an interconnecting panel and to said intermediate panel by means of respective gusset panels, said intermediate panel and the associated gusset panels being disposed in superposed relationship with respect to said top panel when the end closure panels are closed, and said interconnecting panels being disposed in overlapping relationship with upper parts of said side wall panels.

2. A carton according to claim 1, wherein upper parts of each end closure panel are sloped inwardly and upwardly.

3. A carton according to claim 2, wherein said intermediate panel and each of said end closure panels are connected by hinged panels constituting said upper parts of said end closure panels.

4. A carton according to claim 2, wherein said interconnecting panels are hinged to upper parts of the adjacent side wall panels, to upper parts of the adjacent end closure panels and to said intermediate panel.

5. A carton according to claim 2, wherein said gusset panels are connected to said intermediate panels and said upper parts of said end closure panels.

6. A carton according to claim 1, wherein each of said end closure panels is connected to a bottom panel by foldable gusset panels adapted to provide a two-ply element at each lower corner of said carton.

* * * * *